United States Patent [19]

Edwards

[11] 4,151,952

[45] May 1, 1979

[54] AUTOMATIC AIR REGISTER

[76] Inventor: Allen W. Edwards, 405 Hyacinthe Blvd., T.H. 3, Mississauga, Ontario, Canada

[21] Appl. No.: 838,734

[22] Filed: Oct. 3, 1977

[30] Foreign Application Priority Data

Feb. 15, 1977 [GB] United Kingdom ..... 6316/77

[51] Int. Cl.[2] ..... F24F 13/08

[52] U.S. Cl. ..... 236/49; 98/40 VT; 236/101 D

[58] Field of Search ..... 236/49, 96, 101 D, 35.2, 236/93 R; 98/40 VT, 40 C; 165/40

[56] References Cited

U.S. PATENT DOCUMENTS

| | | | |
|---|---|---|---|
| 1,833,950 | 12/1931 | Modine | 236/49 |
| 3,195,441 | 7/1965 | Hedrick | 236/93 X |
| 3,836,073 | 9/1974 | Evans | 98/40 VT |

*Primary Examiner*—William E. Wayner
*Attorney, Agent, or Firm*—Sim & McBurney

[57] ABSTRACT

A self-regulating air register includes a housing through which air can pass, and louvres in the housing for closing and opening the flow path for air. A crank arm is connected to the louvres and can, upon rotation, adjust the degree of closure. A shaft extends through the housing means and a bi-metallic element is connected to the shaft at one end and to a control knob at the other end, the control knob being mounted to the housing and being capable of selective adjustment in terms of angle. Thus, the bi-metallic element is adapted to regulate the angular orientation of the shaft with respect to the housing means. A lever is connected to the shaft and extends perpendicularly therefrom. The lever defines a slot in which part of the crank arm is captive. The slot has a first part arranged such that when the crank arm part is located therein no crank arm rotation is caused by lever rotation. The slot has a second portion disposed such that when the part of the crank arm is located in the second portion, the crank arm is caused to rotate when the lever rotates.

5 Claims, 3 Drawing Figures

AUTOMATIC AIR REGISTER

This invention relates to automatic air registers for air conditioning and heating systems in buildings.

The automatic air register herein disclosed is designed to thermostatically regulate the amount of air, either hot or cold air, forced or convective, which is passing through it.

Accordingly, this invention provides a self-regulating air register comprising: housing means defining a flow path for air from an air duct, louvre means in the housing means for closing and opening said flow path, a crank arm connected to said louvre means and adapted upon rotation to adjust the louvre means, a shaft mounted for rotation with respect to said housing means, a bi-metallic, temperature-sensitive element connected to said shaft and mounted with respect to the housing means such that it can regulate the angular orientation of the shaft with respect to the housing means, and a lever connected to said shaft and disposed perpendicular thereto, the lever having a slot in which part of said crank arm is captive, the slot including a first portion disposed such that when said part of the crank arm is located therein no crank arm rotation is caused by lever rotation, and a second portion disposed such that when said part of the crank arm is located therein the crank arm is caused to rotate when the lever rotates.

One embodiment of this invention is shown in the accompanying drawings, in which like numerals denote like parts throughout the several views, and in which.

Figure 1:
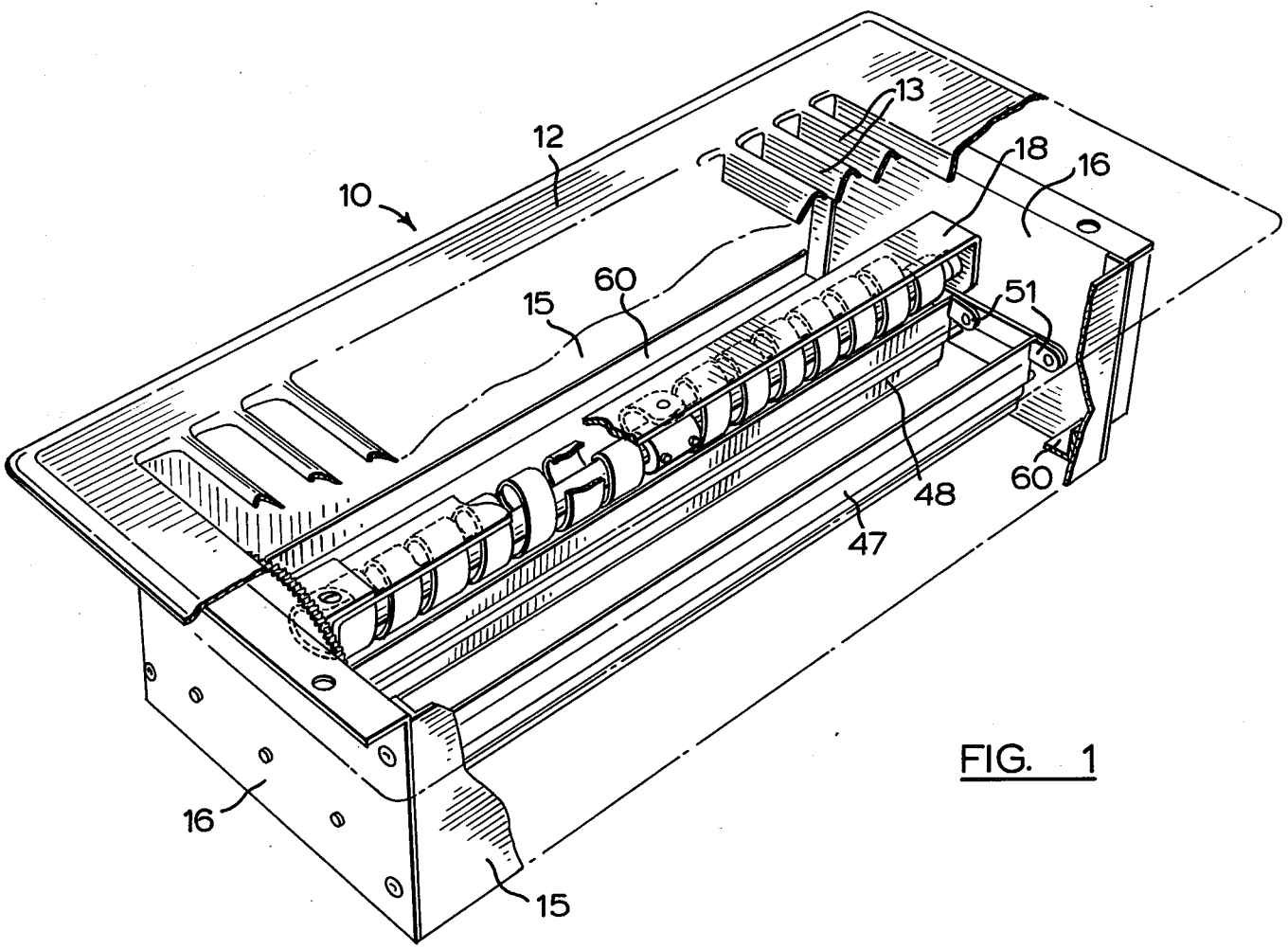
FIG. 1 is a perspective view of the automatic air register of this invention, partly broken away.

Referring first to FIG. 1, the air register shown generally at 10 is seen to consist of a top panel 12 having louvres 13 of conventional construction. A main housing of the air register consists of two vertical side walls 15 and two vertical end walls 16.

Figure 2:
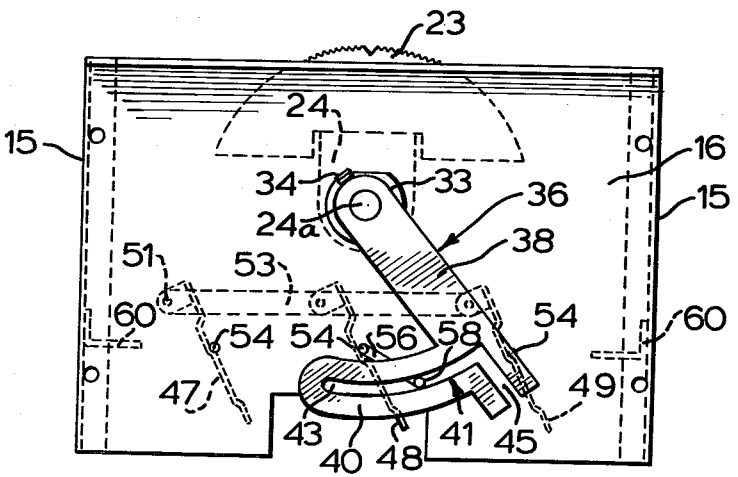
FIG. 2 is an end view of the automatic air register of this invention.
Figure 3:
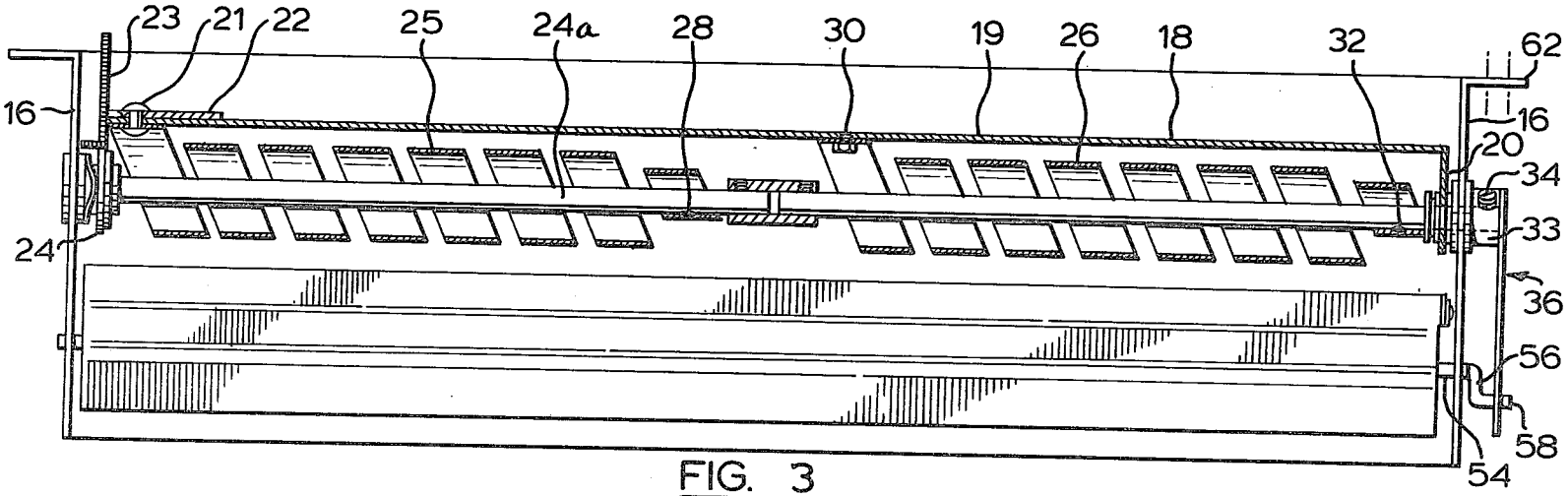
FIG. 3 is an elevational view, partly broken away, of the automatic air register of this invention.

Referring now to all figures, it will be seen firstly that an elongated bracket member 18 is provided centrally and longitudinally of the housing, and that it consists of a longitudinal portion 19 and a downwardly extending vertical end portion 20 at the rightward end as seen in FIG. 3. The leftward end of the bracket member 18 is secured by a rivet 21 to a plate member 22 extending horizontally inwardly from a control knob 23. The control knob 23 is in the shape of a sector of a circle and has a projecting portion 24 which extends to and beyond the location of the centre of curvature of the arcuate sector as can be seen in FIG. 2. The control knob 23 is mounted for rotation about a shaft **24*a* extending the length of the housing and journaled in each of the end walls 16. Thus, digital rotation of the control knob 23 causes the entire bracket member 18 to rotate with the knob 23**.

Mounted around the shaft **24*a* are two helical bi-metallic temperature-sensitive elements 25 and 26. The element 25 has its leftward end secured to the bracket member 18 by virtue of the rivet 21, and has its rightward end secured to the shaft 24*a* by spot welding at 28. The element 26 has its leftward end secured to the bracket member 18 by a threaded fastener 30, and has its rightward end secured to the shaft 24*a* by spot welding at 32**.

The shaft **24*a* extends rightwardly through the rightward end wall 16, and to it is affixed a boss 33 having a threaded securement member 34 to allow it to be adjustably affixed with respect to the shaft 24*a*. Fixed with respect to the boss 33 is a lever 36 which includes a first portion 38 extending radially away from the shaft 24*a*, and a second portion 40 which is arcuate and has its centre of curvature substantially aligned with the axis of the shaft 24*a***.

The lever is shaped to define a slot 41 of which a first portion 43 is arcuate and concentric with the axis of the shaft **24*a* and of which a second portion 45 is substantially radially disposed with respect to the axis of the shaft 24*a***.

Disposed within the housing below the level of the bracket member 18 and the helical bi-metallic elements 25 and 26, are three louvre blades 47, 48 and 49. The louvre blades are all mounted on axes parallel with the axis of the shaft **24*a*, and they are adapted to rotate in tandem. To permit this, each louvre blade includes a perpendicular bracket 51 (see FIG. 1) and a connecting link 53 joins the louvre blades 47–49 together. Elongated pins 54 are affixed to the louvres 47–49 and extend throughout the length of the housing, projecting through the end walls 16. The projecting portions of the pin 54** provide rotational mountings about which the louvre blades can freely swivel.

Looking now at FIG. 3, the rightward end of the pin 54 attached to the middle louvre blade 48 is bent to define a crank arm 56 of which an end part 58 is bent to be parallel with the main extent of the pin, the end part 58 being adapted for capture within the slot 41.

It will be noted particularly in FIG. 2 that the length of the crank arm 56 measured in a direction perpendicular to the main extent of the respective pin (i.e. the actual dimension as seen in end view in FIG. 2) is greater than the distance, measured on a line extending radially from the axis of the shaft **24*a*, between the central pin 54 and the centre line of the first portion 43 of the slot 41. Because the first portion 43 of the slot 41 is arcuate and concentric with the axis of the shaft 24*a*, this means that rotation of the shaft 24*a* and the lever 36 affixed thereto will not cause the crank arm 56 to deviate from the position shown in FIG. 2. This will be the case so long as the end part 58 remains in the first portion 43 of the slot 41**.

Assume now that the lever 36 is rotating in the clockwise direction as seen in FIG. 2. Eventually, the rightward end of the first portion 43 of the slot 41 will arrive at the end part 58 of the crank arm 56, at which point the end part 58 will become lodged in the second portion 45 of the slot 41. This will cause the crank arm 56 to begin rotation in the clockwise sense, which in turn will rotate the louvre blades 47–49 also in the clockwise sense. If this clockwise rotation of the louvre blades 47–49 continues far enough, they will eventually extend in overlapping relation across the housing between the side walls 15, thereby blocking air flow through the housing. Each side wall 15 has affixed thereto an elongated angle bracket 60 against which the extreme lateral portions of the outside louvre blades 47 and 49 may rest to complete the seal.

In some cases it may be desirable to provide a by-pass opening to allow a small bleed-through of air past the housing when it is closed off by the louvre blades 47–49, and such an opening (or openings) can be provided in flange portions 62 at the top of the end wall 16, in angle brackets 60, or in other suitable locations.

It will be appreciated that the second portion 45 of the slot 41 also permits easy disassembly of the device, since it opens downwardly to allow the end part 58 of the crank arm 56 to be removed.

It will now be understood that thermostatic control of the space heated by air passing through the automatic air register 10 shown in the drawings is achieved due to the function of the bi-metallic elements 25 and 26, and the possibility of adjusting that function by using the control knob 23. The bi-metallic elements respond to a change of temperature of the air passing through the register, and the actuation of the mechanical linkage involving the lever 36 is adapted to open or close the louvre blades 47–49.

The configuration of the various portions shown in FIG. 2 is one which will achieve rotation of the louvre blades 47–49 from the fully open to the fully closed position (i.e. slightly over 90° rotation for the louvre blades) while requiring an angular movement of only 15° or 20° on the part of the lever 36. The particular temperature at which this range of 15°–20° is undergone by the lever 36 is of course selected by rotating the control knob 23 to a desired position.

In operation, it is assumed first that the hot air furnace which is adapted to heat the air is off due to the fact that a main thermostat located in the building is not calling for heat. This will allow air in the region of the bi-metallic elements 25 and 26 to cool down to room temperature, either because air is still being forced by the fan but not heated, or because the fan is also off and the air in the ducts is stagnant. In this condition, with the bi-metallic elements 25 and 26 at normal room temperature, the lever 36 will have swung to the maximum distance in the counterclockwise sense as seen in FIG. 2, and this will require the louvre blades 47–49 to assume the position in which they have been drawn in FIG. 2 (in broken lines). In this position they are only slightly off the vertical, and the air register can be considered to be completely "open".

As soon as the furnace begins to heat air to force the heated air through the automatic air register, the bi-metallic elements 25 and 26 will begin to warm up. There is, however, a lag-time before the bi-metallic elements heat to the point necessary to swing the lever 36 far enough in the clockwise sense to bring the end part 58 of the crank arm 56 into contact with the second portion 45 of the slot 41. This lag-time allows the space served by the automatic air register to heat quickly and to attain the desired temperature for that particular space, before the louvre blades 47–49 partly or fully close to reduce the air flow through the automatic air register to the flow volume necessary merely to maintain the space at the temperature which has now been attained. The position of the louvre blades 47–49 at this higher room temperature, with heated air passing through the air register and with the bi-metallic elements 25 and 26 at the same temperature as the hot air, can be adjusted by means of the control knob 23.

This invention may be applied in many situations. Obvious applications are residential-commercial forced air or radiant heating systems, and air conditioning systems. Other suitable applications could involve computers and business machines where ventilation or air flow control is necessary, production machinery where the control of air flow is required, and any and all air control systems where an inexpensive means of controlling air flow would be of advantage.

It is expected that use of the air register disclosed herein will result in conserving substantial quantities of fuel, since inadvertent over-heating of a space through allowing a normal register to remain too widely open for the heating cycle, which is very wasteful of energy, is avoided.

In regard to the residential-commercial forced air heating system application for this invention, it is not a normal practice to install a furnace control thermostat in each individual room of a house, and therefore it is almost impossible to maintain uniform temperature environment in all rooms. The room where the furnace control thermostat is located is usually the only room with a controlled temperature environment. Frequently a system utilizing one control thermostat results in "cold" rooms or "hot" rooms in other parts of the building, due to exposure, location, heating duct configuration, and other causes. In order to heat a "cold" room, it is typical practice to set the single thermostat control for the building to a higher level, but of course this raises the temperature in other rooms which are normally at a higher level. In order to compensate for this difficult situation, standard heat registers normally installed have mechanical baffle arrangements which will control the flow or air from 0% to 100%. However, this adjustment is a static adjustment and is fully manual. If the problem of a "hot" room exists, the register in the room could be manually adjusted to restrict the flow of air passing through it, but this could well result in the same room becoming a "cold" space because the adjustment once made is static.

The automatic air register of this invention is not intended to maintain a constant uniform temperature in a given room. Its prime objective is to provide an automatic control which will permit the unrestricted flow of heated air passing through the register in the shortest possible time upon start up of the furnace, resulting in a shorter period for the warming up of the space involved. As the temperature of the air passing through the register increases, the temperature-sensitive elements located in the register will bring the mechanical linkage into operation and will gradually restrict the volume of air passing through the register to a particular percentage of full flow, depending upon the control setting. This will of course allow a greater portion of the available air to be diverted to other channels in the heating system.

There are several additional advantages of the automatic air register of this invention.

Firstly, a more equitable and efficient automatic distribution of heated air in the system will result in less fuel consumption per furnace air, and a reduced electrical energy requirement due to a shorter furnace operating cycle.

Secondly, the individual room automatic registers will automatically divert heated air back into the system according to their control setting, which will in turn decrease the average warm up time of other difficult-to-heat rooms since a greater volume of heated air will be available to them. This in turn will reduce the average furnace operating cycle time, and the maintenance requirements of the system. Extended air filter life is also expected to be attained.

Finally, once a suitable control setting has been selected for a given air register, the same will thermostatically and automatically operate, requiring a minimum of further adjustments. This will thus provide a supplemental support system in conjunction with the furnace control thermostat.

In terms of the register itself, it will be appreciated that no maintenance is necessary for the automatic air register, aside from a periodic cleaning, which could be carried out by rinsing in hot water. Secondly, no electrical or mechanical services are required, and the unit can be installed in a matter of seconds. The mounting position is not a limitation, since horizontal, vertical or upside-down mounting would not interfere with operation. And of course, the unit can also be fitted into older systems by replacing the manual, static registers.

Since, no electrical or mechanical system is involved which interlinks the air registers together or with a previous system, the cost of installation for a completely automated thermostatic control system for individually controlling separate spaces within a single building would be relatively low.

It is considered that the air register provided herein will bridge the gap between the main furnace thermostatic control and the point at which controlled air is released into the environment, namely at the register. It provides a complementary control support function automatically, while also fulfilling the basic function of a register.

In place of the elements 25 and 26 described above and shown in the drawings, it is possible to substitute any of the following:

a. A spiral bi-metal coil.

b. A flat bi-metal strip.

c. A cantilever bi-metal.

d. A symmetrical or non-symmetrical "U" shape bi-metal.

e. A wire bi-metal.

f. An "L" shaped bi-metal.

g. A trapezoidal beam bi-metal.

h. A disc bi-metal.

i. A combination spiral helix bi-metal.

It would also be possible to control individual or groups of baffles with one or more bi-metal shape each, or a combination of shapes. Furthermore, one could dispense with baffles and use a suitably shaped bi-metal component by itself to control the air flow. In other words, the bi-metal components would be in place of the baffles, and its angulation or curvature upon temperature change would suffice to change the air flow through the register. It should also be pointed out that it would be possible to use an auxiliary heater in conjunction with a bi-metal shape in order to establish a system of calibration control.

What I claim is:

1. A self-regulating air register comprising:

housing means defining a flow path for air from and air duct, louvre means in the housing means for closing and opening said flow path, a crank arm connected to said louvre means and adapted upon rotation to adjust the louvre means, a shaft mounted for rotation with respect to said housing means, a bi-metallic, temperature-sensitive element connected to said shaft and mounted with respect to the housing means such that it can regulate the angular orientation of the shaft with respect to the housing means, and a lever connected to said shaft and disposed perpendicular thereto, the lever having a slot in which part of said crank arm is captive, the slot including a first portion disposed such that when said part of the crank arm is located therein no crank arm rotation is caused by lever rotation, and a second portion disposed such that when said part of the crank arm is located therein the crank arm is caused to rotate when the lever rotates.

2. The invention claimed in claim 1, in which the first portion of the slot is arcuate and concentric with the axis of said shaft, and in which the second portion of the slot is substantially radially disposed with respect to the axis of said shaft.

3. The invention claimed in claim 1, in which the louvre means includes a plurality of louvre blades mounted to rotate in tandem about axes parallel with the axis of said shaft, the crank arm being attached to one louvre blade and rotating therewith, said part of the crank arm being spaced from the rotational axis of the louvre blade to which the crank arm is attached.

4. The invention claimed in claim 2, in which the crank arm, when said end part is located in the first portion of the slot, maintains substantially a single oblique orientation with respect to a radial line from the shaft axis.

5. The invention claimed in claim 1, in which the said element includes at least one helically configured bi-metallic strip of which one end is affixed to said shaft, and of which the other end is connected to an adjustment member, the latter being capable of assuming selected orientations with respect to the housing means whereby the said other end of the bi-metallic strip is adjustable in orientation.

* * * * *